US009918154B2

(12) United States Patent
Timothy et al.

(10) Patent No.: US 9,918,154 B2
(45) **Date of Patent: *Mar. 13, 2018**

(54) TACTILE VIBRATION DRIVERS FOR USE IN AUDIO SYSTEMS, AND METHODS FOR OPERATING SAME

(71) Applicant: Skullcandy, Inc., Park City, UT (US)

(72) Inventors: John Timothy, Salt Lake City, UT (US); Sam Noertker, Park City, UT (US)

(73) Assignee: SKULLCANDY, INC., Park City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/814,068

(22) Filed: Jul. 30, 2015

(65) Prior Publication Data

US 2017/0034612 A1 Feb. 2, 2017

(51) Int. Cl.
*H04R 25/00* (2006.01)
*H04R 1/10* (2006.01)
(Continued)

(52) U.S. Cl.
CPC ..... *H04R 1/1016* (2013.01); *G08B 6/00* (2013.01); *H04R 1/10* (2013.01); *H04R 9/025* (2013.01);
(Continued)

(58) Field of Classification Search
CPC ..... H04R 1/1016; H04R 1/10; H04R 9/025; H04R 9/063; H04R 1/1008; H04R 2400/03; H04R 2460/13; G08B 6/00
(Continued)

(56) References Cited

U.S. PATENT DOCUMENTS 7,324,655 B2 1/2008 Sato
8,965,028 B2 2/2015 Oishi et al.
(Continued)

FOREIGN PATENT DOCUMENTS

EP 3054702 A1 8/2016
WO 2015012303 A1 1/2015
WO 2016049284 A1 3/2016

OTHER PUBLICATIONS

European Search Report for European Application No. 16181704, dated Dec. 16, 2016, 6 pages.

*Primary Examiner* — Davetta W Goins
*Assistant Examiner* — Phylesha Dabney
(74) *Attorney, Agent, or Firm* — TraskBritt

(57) ABSTRACT

A tactile vibration driver for use in a headphone includes a support structure, at least one suspension member suspending at least one rigid member relative to the support structure, and a plurality of magnetic members attached to the at least one rigid member and configured to drive oscillating movement of the at least one rigid member and the at least one suspension member so as to produce tactile vibrations during operation of the tactile vibration driver. An audio system includes the tactile vibration driver. A method of operating an audio system includes driving a plurality of magnetic members attached to a rigid member of the tactile vibration driver to cause oscillations of the plurality of magnetic members and the rigid member relative to a suspension member and producing tactile vibrations responsive to receipt of an electrical signal.

12 Claims, 16 Drawing Sheets

(51) Int. Cl.
*G08B 6/00* (2006.01)
*H04R 9/02* (2006.01)
*H04R 9/06* (2006.01)

(52) U.S. Cl.
CPC ..... *H04R 9/063* (2013.01); *H04R 1/1008* (2013.01); *H04R 2400/03* (2013.01); *H04R 2460/13* (2013.01)

(58) Field of Classification Search
USPC ..... 381/151, 309, 374
See application file for complete search history.

(56) References Cited

U.S. PATENT DOCUMENTS

| | | | | |
|---|---|---|---|---|
| 9,100,745 | B2 * | 8/2015 | Oishi | H04R 1/1041 |
| 9,319,770 | B2 * | 4/2016 | Oishi | H04R 1/105 |
| 9,549,260 | B2 * | 1/2017 | Oishi | H04R 5/033 |
| 2008/0112581 | A1 | 5/2008 | Kim et al. | |
| 2009/0285417 | A1 | 11/2009 | Shin et al. | |
| 2010/0246861 | A1 | 9/2010 | Han et al. | |
| 2012/0177195 | A1 | 7/2012 | Elliott et al. | |
| 2013/0046131 | A1 | 2/2013 | Ball et al. | |
| 2013/0129129 | A1 | 5/2013 | Haakansson | |
| 2014/0056459 | A1 * | 2/2014 | Oishi | H04R 31/00 381/370 |
| 2015/0172805 | A1 * | 6/2015 | Oishi | H04R 31/00 381/370 |
| 2015/0189441 | A1 * | 7/2015 | Oishi | H04R 5/033 381/309 |
| 2015/0195664 | A1 * | 7/2015 | Lin | H04R 29/00 381/58 |
| 2016/0165249 | A1 * | 6/2016 | Yamamoto | H04N 19/70 375/240.12 |
| 2016/0234588 | A1 * | 8/2016 | Timothy | H04R 1/1091 |

* cited by examiner

TACTILE VIBRATION DRIVERS FOR USE IN AUDIO SYSTEMS, AND METHODS FOR OPERATING SAME

FIELD

The disclosure relates generally to tactile vibration drivers for use in audio systems. More specifically, disclosed embodiments relate to tactile vibration drivers configured to generate tactile vibrations that may be sensed by a person using an associated headphone of an audio system, to headphones including such tactile vibration drivers, and to methods of operating and using such tactile vibration drivers and headphones.

BACKGROUND

Conventional portable audio systems often include a headphone that is connected to a media player (e.g., by one or more wires or by wireless technology). Conventional headphones may include one or two ear cup assemblies, each including an audio driver (i.e., a speaker) configured to produce audible sound waves with a diaphragm. For example, FIGS. 1 and 2 illustrate audio drivers 100 and 200, respectively, for a conventional headphone.

Referring to FIG. 1, the audio driver 100 may include a diaphragm 110 connected to a rim of a support structure 120, which may cause the outer edge of the diaphragm to be relatively rigid. In the center area of the diaphragm 110 is a cone member coupled to a magnetic member (e.g., a coil or a magnet). The portion of the diaphragm outside of the cone member may form a suspension member that, at least in part, determines the stiffness of the diaphragm 110. The diaphragm 110 permits the magnetic member attached to the diaphragm 110 to move back and forth responsive to a varying magnetic field generated by an audio signal. As a result, the diaphragm 110 generates audible sound waves in the air proximate the audio driver 100 that correspond to the frequencies of the audio signals.

Referring to FIG. 2, in additional previously known speaker systems, an audio driver 200 may include one or more metal suspension members 210 (instead of a plastic diaphragm) connected to a rim of a support structure 220. The suspension member 210 may be generally circular, and may have flexible beams connecting a radially outer rigid portion and a radially inner rigid portion. The radially inner rigid portion forms a platform to which a coil or a magnet may be attached.

Ear cup assemblies of headphones may also include tactile vibration drivers that are configured to generate tactile vibrations within the ear cup assemblies that may be felt by the user. Headphones including such tactile vibration drivers are disclosed in, for example, U.S. Pat. No. 8,965,028, which issued Feb. 24, 2015, the contents of which are incorporated herein in their entirety by this reference.

BRIEF SUMMARY

In accordance with one embodiment described herein, a tactile vibration driver for use in a headphone comprises a support structure, at least one suspension member suspending at least one rigid member relative to the support structure, and a plurality of magnetic members attached to the at least one rigid member and configured to drive oscillating movement of the at least one rigid member and the at least one suspension member so as to produce tactile vibrations during operation of the tactile vibration driver.

In additional embodiments, an audio system including a media player configured to send an electrical audio signal to at least one tactile vibration driver of the audio system is described. The at least one tactile vibration driver comprises at least one rigid member, at least one suspension member coupled to the at least one rigid member and a support structure, and a plurality of magnetic members attached to the at least one rigid member, wherein each magnetic member of the plurality of magnetic members is configured to oscillate relative to the support structure and generate tactile vibrations responsive to receipt of the electrical audio signal.

In additional embodiments, a method of operating a tactile vibration driver comprises driving a plurality of magnetic members attached to a rigid member of the tactile vibration driver to cause oscillations of the plurality of magnetic members and the rigid member relative to a suspension member and producing tactile vibrations responsive to receipt of an electrical signal.

DETAILED DESCRIPTION

Figure 1:
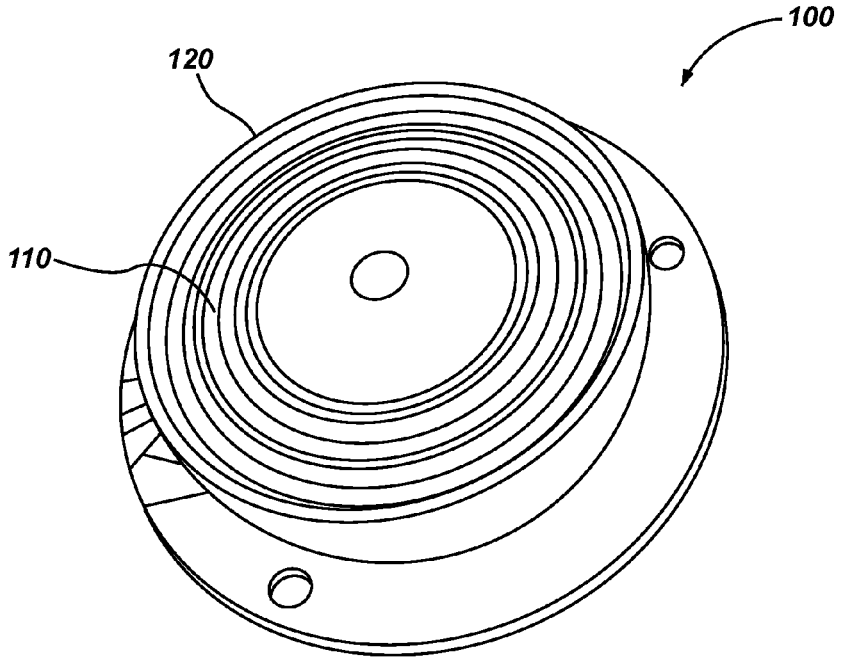
FIG. 1 illustrates a conventional audio driver for a headphone.
Figure 2:
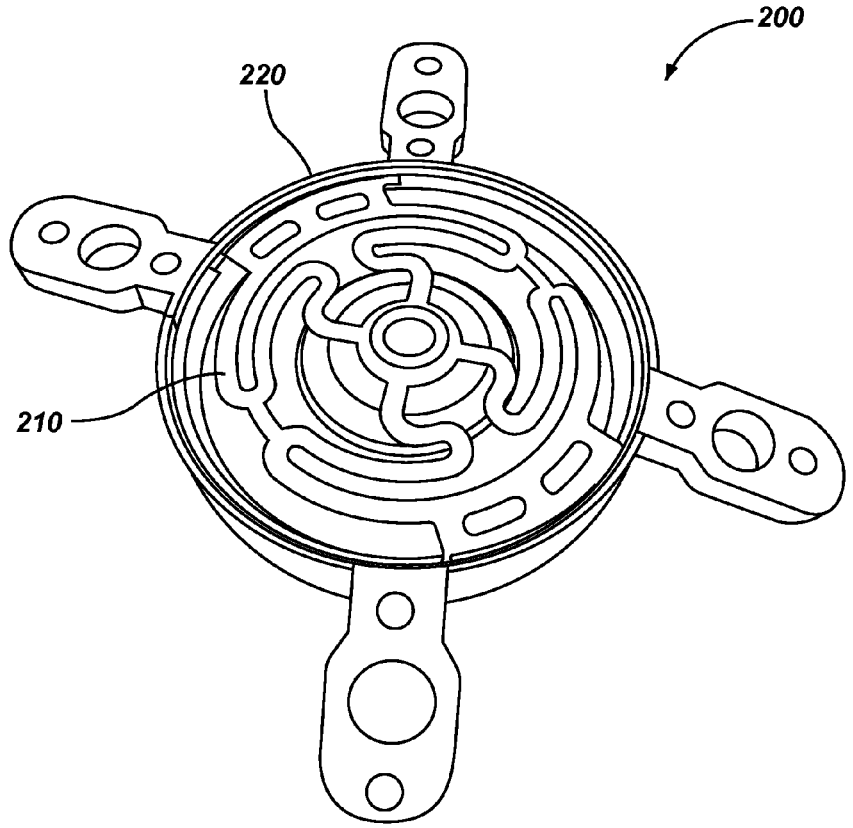
FIG. 2 illustrates another conventional audio driver for a headphone.

In the following description, reference is made to the accompanying drawings in which is shown, by way of illustration, specific embodiments of the present disclosure. The embodiments are intended to describe aspects of the disclosure in sufficient detail to enable those skilled in the art to practice the invention. Other embodiments may be utilized and changes may be made without departing from the scope of the disclosure.

Disclosed embodiments relate generally to tactile vibration drivers that are configured to generate tactile vibrations that may be felt by a person using the tactile vibration drivers or a headphone including one or more tactile vibration drivers. In particular, disclosed embodiments may include a headphone including one or more tactile vibration drivers configured to generate tactile vibrations responsive to receiving an electrical signal, such as an electrical audio signal. In some embodiments, the tactile vibration driver may be configured as a multi-actuator system to generate vibrations that may be physically felt in a tactile manner by the user. The tactile vibration driver may include multiple voice coil/magnet actuators that may be driven at the same operating frequency. By providing a plurality of actuators, the tactile vibration driver may be non-circular and/or non-planar in shape and may include a plurality of actuators disposed around a particular area where tactile vibrations are desired, as opposed to a single actuator centered in a generally circular and generally planar tactile vibration driver assembly. The actuators may be a Lorentz force actuator typically consisting of a coil of wire and a magnet. The actuators may include a magnetic member (e.g., a physical magnet) surrounded by one or more electrically conductive wire coils, and the tactile vibration driver may include a multi-actuator transducer in which multiple actuators are placed at different locations relative to a suspension member to create the tactile vibrations.

Such a tactile vibration driver with a plurality of actuators may be used in headphones configured to contact a user in asymmetric volumes and spaces where conventional speakers and headphones configured to generate tactile vibrations may not fit in a comfortable manner. The tactile vibrations may be applied to non-planar surfaces of a head or other anatomical features of a user because the tactile vibration driver includes a plurality of actuators rather than only a single actuator. For example, the tactile vibration drivers and/or headphones including the tactile vibration drivers may be configured to conform to a shape of a user's head (e.g., wrap around or behind a user's ear, contact a user's head distal from the ear), conform to a touch point of a user (e.g., hands or fingers of a user playing a gaming console), or fit within an ear cup. The tactile vibration driver may be located proximal to or remote from an audio driver associated with the headphone, providing a low profile assembly since the tactile vibration driver may not be stacked vertically over the audio driver.

As used herein, the term "audio driver" means and includes an acoustic transducer device configured primarily to generate audible sound waves, such as with the reproduction of speech, music, or other audible sound. An audio driver may be configured primarily to emit audible sound frequencies, although some minor tactile vibrations may be generated by an audio driver.

As used herein, the term "tactile vibration driver" means and includes a transducer device configured primarily to generate tactile vibrations that may be felt in a tactile manner by a user, although some low frequency audible sound may also be generated by a tactile vibration driver. While examples are described herein for tactile vibration drivers that are incorporated within headphones, tactile vibration drivers as described herein may be employed in other non-headphone devices.

As used herein, the term "magnetic member" means and includes an electrically conductive wire coil or a magnet (e.g., a permanent magnet) that is used to form a coil/magnet pair of a tactile vibration driver that is driven by electrical current passing through the coil to generate a magnetic field, which applies a magnetic force between the magnet and coil so as to generate back and forth relative movement therebetween. In some configurations of tactile vibration drivers as described herein, a coil may be coupled to a movable member (e.g., a diaphragm), while a magnet is coupled to a support structure (e.g., a basket or frame of the tactile vibration driver), while in other embodiments, a magnet may be coupled to the movable member and a coil is coupled to the support structure. A changing magnetic field caused by electrical current passing through the coil may cause physical, oscillating displacement of the magnetic members coupled to the movable member relative to the support structure. The rigid members may be sufficiently rigid such that the rigid members may support one or more magnetic members coupled thereto without substantially deforming.

As used herein, the term "bass frequency" means and includes any frequency within the range extending from approximately 16 Hz to approximately 512 Hz. For purposes of this disclosure, a "low bass frequency" refers to bass frequencies that may be felt in a tactile manner as well as heard. Such low bass frequencies may be within the range extending from approximately 16 Hz to approximately 200 Hz. A "lower midrange frequency" is generally considered to be within the range extending from 512 Hz to 2.6 kHz. An "upper midrange frequency" is generally considered to be within the range extending from 2.6 kHz to 5.2 kHz. A "high end frequency" is generally considered to be within the range extending from 5.2 kHz to 20 kHz.

Figure 3:
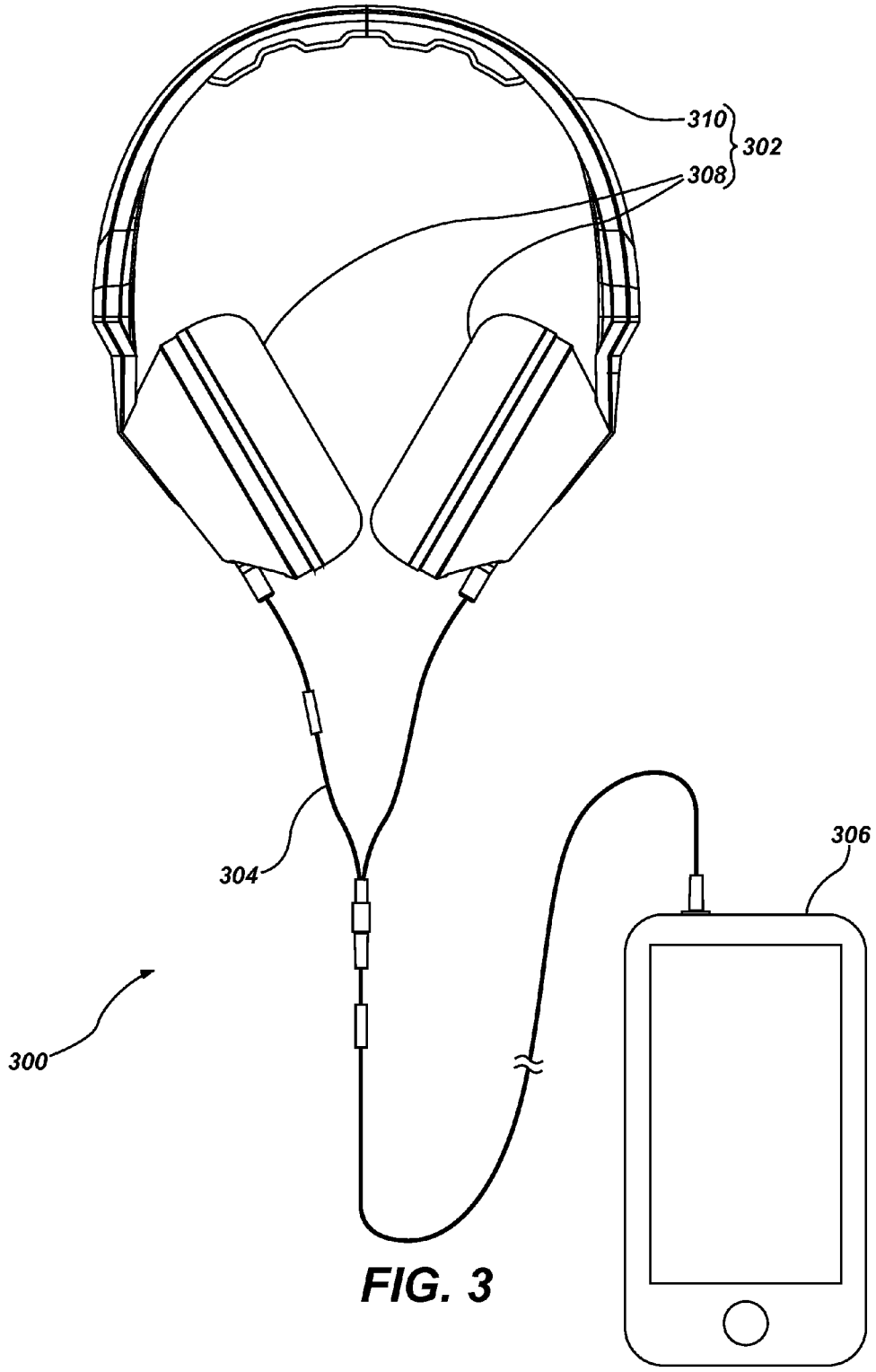
FIG. 3 is a simplified view of an embodiment of an audio system in accordance with an embodiments of the present disclosure.

FIG. 3 illustrates an audio system 300 according to an embodiment of the present disclosure. The audio system 300 may include a headphone 302, a wiring system 304, and a media player 306. The headphone 302 and media player 306 may be connected to the wiring system 304 such that audio signals carried by the wiring system 304 are transmitted from the media player 306 to the headphone 302. Thus, an audio signal generated by the media player 306 may be transmitted through the wiring system 304 to the headphone 302 where the audio signal is converted to audible sound and tactile vibrations. In additional embodiments, the audio system 300 may wirelessly transmit the audio signal to the headphone 302.

The headphone 302 may comprise two ear cup assemblies 308 and a headband 310. The headband 310 may be configured to rest on a user's head, and to support the two ear cup assemblies 308 when in use. The headband 310 may also be configured to position the two ear cup assemblies 308 attached to the headband 310 proximate (e.g., on or over) a user's ears such that sound emitted from the ear cup assemblies 308 is heard by the user. In yet further embodiments, the headphone 302 may comprise earbud assemblies (which may or may not be carried on a headband 310), which may include earbud speakers that may be inserted into the ears of the user.

The media player 306 may include any device or system capable of producing an audio signal and connectable to a headphone to convert the audio signal to audible sound and tactile vibrations. For example, the media player 306 may include smart phones or other phones, gaming systems, DVD players or other video players, laptop computers, tablet computers, desktop computers, stereo systems, microphones, personal digital assistants (PDAs), eBook readers, and music players such as digital music players, portable CD players, portable cassette players, etc. Other types of media players are also contemplated. As shown in FIG. 3, the media player 306 may comprise, for example, an IPHONE® commercially available from Apple of Cupertino, Calif.

The ear cup assemblies 308 may include an audio driver configured to convert the audio signal to audible sound and a tactile vibration driver configured to generate a tactile response (e.g., vibrations), as described in further detail hereinbelow.

Figure 4:
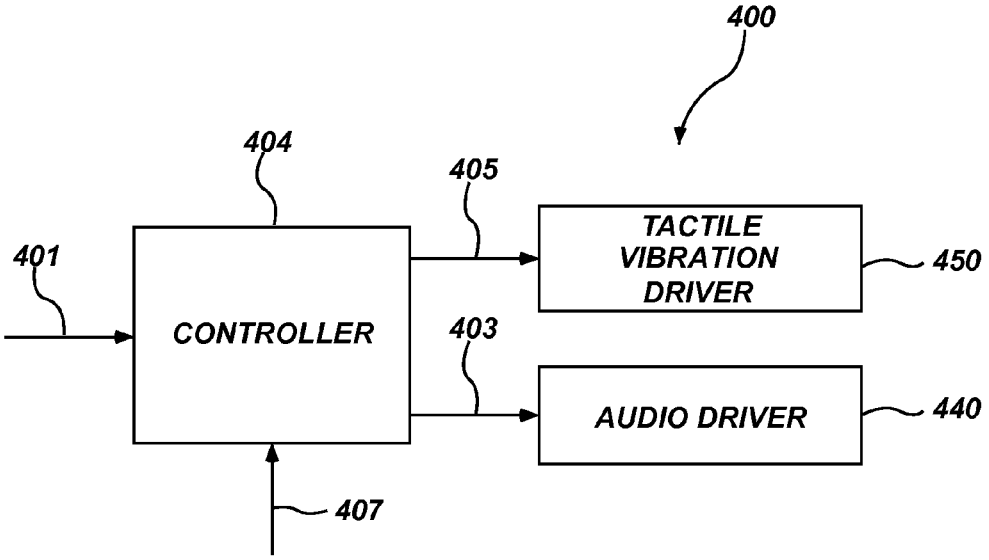
FIG. 4 is a simplified block diagram of a driver system in accordance with embodiments of the present disclosure.

FIG. 4 is a simplified block diagram of one driver system 400 according to an embodiment of the present disclosure. Such a driver system 400 may be included in the audio system 300, such as within each of the ear cup assemblies 308 of FIG. 3, to convert an audio signal 401 to audible sound and a tactile response including vibrations that may be felt in a tactile manner by the user. The driver system 400 includes an audio driver 440 configured to emit sound at audible frequencies, and an additional, separate tactile vibration driver 450 configured to generate tactile vibrations within the ear cup assemblies 308 that may be felt in a tactile manner by the user. As discussed above, the audio driver 440 is configured primarily to emit audible sound frequencies, although some minor tactile vibrations may be generated by the audio driver 440 in some embodiments. The tactile vibration driver 450 is configured primarily to generate tactile vibrations, although some low frequency audible sound may also be generated by the tactile vibration driver 450 in some embodiments. The audio driver 440 and the tactile vibration driver 450 may be located within the same or different housings of the ear cup assemblies 308.

The driver system 400 may include a controller 404 configured to receive an input audio signal 401 (e.g., from the media player 306 (FIG. 3)) and transmit a first audio signal 403 to the audio driver 440 and a second audio signal 405 to the tactile vibration driver 450. The second audio signal 405 may be an electrical audio signal that drives the tactile vibration driver 450. In some embodiments, the controller 404 may include frequency filters (e.g., a low-pass frequency filter, a high-pass frequency filter, etc.) such that the first audio signal 403 includes medium to high frequencies (e.g., lower midrange, upper midrange, high end), while the second audio signal 405 includes the bass frequencies, or at least low bass frequencies. In some embodiments, the first audio signal 403 may include at least some bass and/or low bass frequencies, while the second audio signal 405 may include at least some lower midrange, upper midrange, and/or high end frequencies. In addition, at least some of the frequencies of the first audio signal 403 and the second audio signal 405 may at least partially overlap. For example, the audio driver 440 may be configured to emit some bass frequencies that are further enhanced by the tactile vibration driver 450. In addition, the audio driver 440 may be configured to emit lower midrange, upper midrange, and/or high end frequencies that are further enhanced by the tactile vibration driver 450. In other embodiments, substantially the same audio signal may be supplied to both the audio driver 440 and to the tactile vibration driver 450.

Referring still to FIG. 4, the controller 404 may further include control logic configured to modify the audio signals 403, 405 responsive to a control signal 407. For example, the control signal 407 may control characteristics of the first audio signal 403 and/or the second audio signal 405, respectively, such as volume. The controller 404 may be configured to control the first audio signal 403 and the second audio signal 405 independently. For example, a user may desire louder bass frequencies and a stronger tactile response at the bass frequencies. As a result, more power may be supplied to the tactile vibration driver 450 relative to the power supplied to the audio driver 440.

Figure 5:
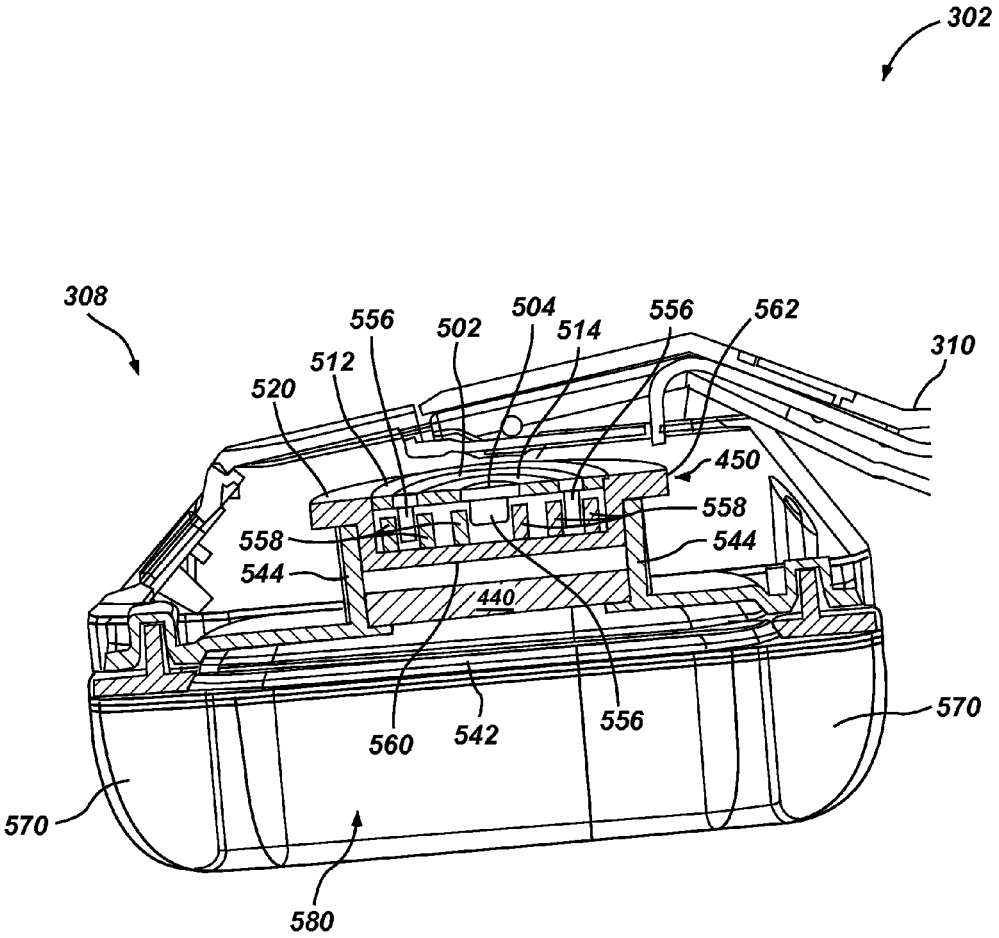
FIG. 5 is a cross-sectional side view of a portion of the headphone of FIG. 3.

FIG. 5 is a cross-sectional side view of a portion of the headphone 302 of FIG. 3. The headphone 302 may include the ear cup assembly 308 connected to the headband 310. The headphone 302 may include two such ear cup assemblies 308 on opposing sides of the headband 310. The ear cup assembly 308 may be configured to rest on or over the ear of the user. The ear cup assembly 308 may include an air cavity 580 and a cushion 570 surrounding the air cavity 580 for comfort when worn over the ear of the user. The ear cup assembly 308 may further include the audio driver 440 configured to emit sound at audible frequencies, and an additional, separate tactile vibration driver 450 configured to generate tactile vibrations within the ear cup assembly 308 that may be felt in a tactile manner by the user. In some embodiments, the ear cup assembly 308 may further include a plate 542 positioned between the audio driver 440 and the air cavity 580. The tactile vibration driver 450 may be located within a housing of the ear cup assembly 308. In other embodiments, the tactile vibration driver 450 may be located outside of the housing of the ear cup assembly 308, such as being connected to an external surface of the ear cup assembly 308. In yet other embodiments, the tactile vibration driver 450 may be located distal the housing of the ear cup assembly 308 and may be located in a separate housing than the audio driver 440. By way of non-limiting example, the tactile vibration driver 450 may be located behind an ear of a user and may be configured to conform to a shape of the head of the user.

The tactile vibration driver 450 may include a plurality of rigid members 502, 504, and a plurality of suspension members 512, 514. The rigid members 502, 504 may exhibit a suitable stiffness so that the entire rigid member 502, 504 moves together when being displaced as opposed to different regions deforming non-uniformly.

A first rigid member 502 may be coupled to a support structure 520 via the first suspension member 512. The first rigid member 502 and the second rigid member 504 may be coupled together via the second suspension member 514. The rigid members 502, 504 may be configured for mounting a plurality of magnetic members 556 (i.e., magnets and/or coils) thereon. As shown in FIG. 5, the tactile vibration driver 450 may include the rigid member 504 (e.g., inner platform portion) that has a central magnetic member 556 (e.g., coil or magnet) coupled thereto. For example, the central magnetic member 556 may be attached to the underside of the rigid member 504 of the tactile vibration driver 450. Peripheral magnetic members 556 may be attached to the underside of the first rigid member 502. At least one rigid member 502, 504 may include a plurality of magnetic members 556 thereon. At least one rigid member 502, 504 of the tactile vibration driver 450 may also have an additional optional weight mounted thereon to increase the mass thereof and to achieve a desired resonant frequency for the tactile vibration driver 450.

The support structure 520 may further include a lower support member 560, a circumferentially extending rim 562, and a frame support member 544. A radially outer portion of the first suspension member 512 may be connected to the circumferentially extending rim 562, such as by adhesive, a fastener, a snap fit, etc. The tactile vibration driver 450 may further include additional magnetic members 558 (e.g., coils or magnets). The additional magnetic members 558 may be coupled to the lower support member 560 within a cavity between the lower support member 560 and the suspension members 512, 514 of the tactile vibration driver 450.

In some embodiments, the additional magnetic members 558 may comprise coils and the magnetic members 556 may comprise magnets. The coils (e.g., the additional magnetic members 558) may be configured to generate a magnetic field responsive to an electrical signal (e.g., second audio signal 405 (FIG. 4)). The resulting magnetic field may oscillate based, at least in part, on the frequency of the audio signal. The magnetic members 556 may respond to the force of the oscillating magnetic field such that the magnetic members 556 and suspension members 512, 514 are displaced relative to the resting plane. As a result, tactile vibrations are generated within the ear cup assembly 308 by the displacement of the magnetic members 556. In other embodiments, the magnets and coils are reversed such that the magnetic members 556 are coils and the additional magnetic members 558 are magnets.

The tactile vibration driver 450 may be oriented parallel with the plate 542 in some embodiments. In other words, the vibrations of the tactile vibration driver 450 may be at least substantially perpendicular, or at an acute angle to the plate 542. The vibrations caused from the displacement of the tactile vibration driver 450 may cause the plate 542 to vibrate. While vibrating, the plate 542 may produce pressure waves in the air cavity 580, which may enhance the certain frequencies that are approximately near the vibration frequencies produced by the operation of the tactile vibration driver 450. The pressure waves and other physical vibrations in the headphone 302 may be felt as tactile vibrations to the user, which may further enhance the user's listening experience. Some modifications to the headphone 302 may affect the feel of the tactile vibrations generated by at the bass frequencies. For example, the size of the air cavity 580 may affect the strength of the tactile vibrations. Forming apertures in the plate 542 may have a similar effect as increasing the size of the air cavity 580, as the effective size of the air cavity 580 would be increased so as to include some volume of space within the ear cup assembly behind the plate 542.

As discussed above, FIG. 5 shows a single ear cup assembly 308; however, it should be recognized that the headband 310 may be coupled to two such ear cup assemblies 308 (i.e., one for each ear). In some embodiments, each pair of ear cup assemblies 308 may be configured the same. For example, the resonant frequency of each of the tactile vibration drivers 450 may be the same for the right ear cup assembly as well as the left ear cup assembly. In some embodiments, however, the ear cup assemblies of a headphone may have different components therein. For example, one of the ear cup assemblies may include a battery for providing power or electronic components thereto that are not included in the other ear cup assembly. The added weight of the battery or electronic components may affect the overall resonant frequency of the tactile vibration driver 450 associated with that ear cup assembly 308. To compensate for such a difference in resonant frequencies, the tactile vibration driver 450 on one side of the headphone 302 may be configured to exhibit a resonant frequency that is different than the tactile vibration driver 450 on the other side of the headphone 302.

Figure 6A:
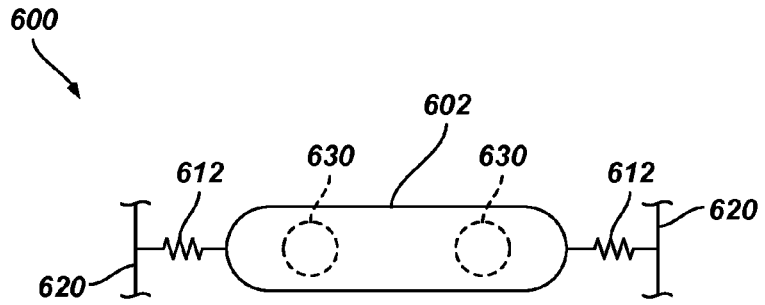
FIG. 6A is a simplified schematic diagram representing a top view of a tactile vibration driver in accordance with an embodiment of the present disclosure.

FIG. 6A is a simplified schematic diagram representing a top view of a tactile vibration driver 600 according to an embodiment of the present disclosure. The tactile vibration driver 600 may include a rigid member 602. The rigid member 602 may be coupled to a support structure 620 via a suspension member 612. The rigid member 602 may be generally rectangular in shape and may include rounded corners or ends. Although the rigid member 602 is shown as having a generally rectangular shape, the rigid member 602 may be square-shaped, oval-shaped, or may have any other shape in additional embodiments.

The suspension member 612 is shown symbolically in FIG. 6A as a spring rather than as a physical representation. The suspension member 612 may comprise, for example, a diaphragm or one or more metal suspension members as described herein, but having appropriate shapes for the particular tactile vibration driver in which they are employed. Referring still to FIG. 6A, in some embodiments, the suspension member 612 may comprise flexible beams extending between the rigid member 602 and the support structure 620. Examples of such flexible beams are described in U.S. Pat. No. 8,965,028, which issued Feb. 24, 2015, and entitled, "Speakers, Headphones, and Kits Related to Vibrations in an Audio System, and Methods for Forming Same," the contents of which are incorporated herein in their entirety by this reference. Any number of beams is contemplated (e.g., 2, 3, 4, etc.) depending on the desired flexibility and resonant frequency. The flexible beams may be evenly spaced around the periphery of the rigid member 602 depending on the number of flexible beams used. In other embodiments, the suspension member 612 may comprise a single structure (e.g., a flexible diaphragm, a passive radiator, etc.) having an appropriate spring constant. In some embodiments, the suspension member 612 may surround only a portion of the rigid member 602. In other embodiments, the suspension member 612 may entirely surround the rigid member 602.

The tactile vibration driver 600 may also include a plurality of magnetic members 630 associated with the rigid member 602. The magnetic members 630 may be attached in fixed manner to the rigid member 602. In some embodiments, the magnetic members 630 are attached to an underside of the rigid member 602. Each of the magnetic members 630 may be driven with the same signal so that the same forces are applied to the rigid member 602 at different locations relative to rigid member 602 corresponding to the locations of the magnetic members 630. In some embodiments, magnetic members 630 coupled to the same rigid member (e.g., rigid member 602) may be driven with the same signal (e.g., the second audio signal 405 (FIG. 4)) so that the same forces are applied to the rigid member at different locations corresponding to the locations of the magnetic members (e.g., magnetic members 630) on the rigid member.

While FIG. 6A illustrates two magnetic members 630 coupled to the rigid member 602, it is contemplated that any number of magnetic members 630 (e.g., coils or physical magnets) greater than one may be coupled to the rigid member 602. As discussed above, the magnetic members 630 on the rigid member 602 and magnetic members on the support structure 520 (FIG. 5) may form coil/magnet pairs that are configured to cause displacement of the rigid member 602 responsive to an audio signal. Thus, the magnetic members 630 may include coils and/or magnets depending on the particular configuration used to drive the tactile vibration driver 600.

In operation, a magnetic field generated by current flowing through a wire coil may change responsive to the audio signal received by the tactile vibration driver 600. The changing magnetic field causes physical, oscillating displacement of the magnetic members 630 and rigid member 602 relative to the support structure 620, and corresponding vibrations in the suspension member 612 to which the magnetic members 630 and rigid member 602 are attached. Thus, the tactile vibration driver 600 may have multiple coil/magnet pairs that may be driven at the same frequency. The resulting vibrations may cause an increased tactile response (e.g., vibrations) that is experienced by the user.

The tactile vibration driver 600 may be configured as a multi-actuator tactile vibration driver 600 having two or more actuators, with each coil/magnet pair of the plurality defining an actuator. Providing the tactile vibration driver 600 with multiple actuators may provide vibrations on surfaces that are asymmetric, non-planar, or in confined spaces. Each actuator may vibrate in unison to create vibrations in the rigid member 602 associated with the actuators. The tactile vibration driver 600 may have any desired size and/or shape. For example, the tactile vibration driver 600 may be sized and shaped to fit within asymmetric volumes (e.g., an area behind an ear of a user), or on uneven surfaces, such as surfaces of a user's head, and the tactile vibrations may be generated by a plurality of actuators rather than a single actuator. In some embodiments, the tactile vibration driver 600 may be configured to fit within a relatively small volume of an ear cup.

Figure 6B:
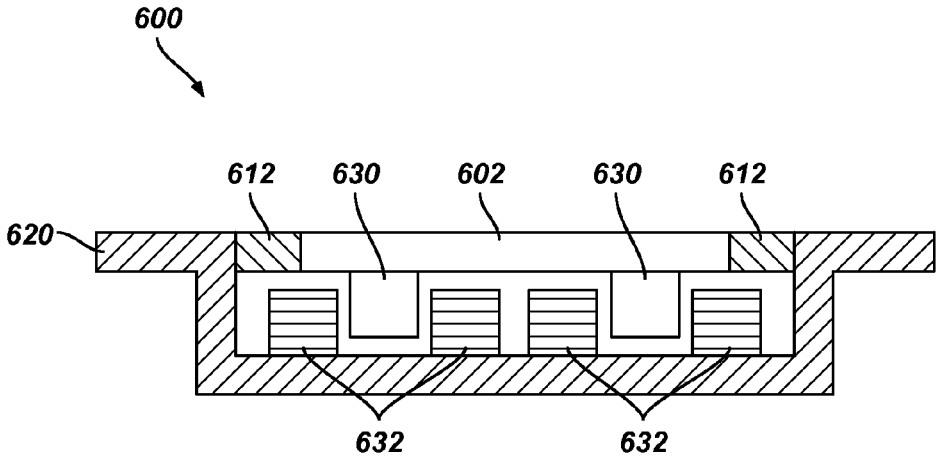
FIG. 6B is a simplified schematic illustrating a cross-sectional side view of the tactile vibration driver of FIG. 6A.

FIG. 6B is a simplified schematic illustrating a cross-sectional side view of the tactile vibration driver 600 of FIG. 6A. The tactile vibration driver 600 may include a plurality of magnetic members 632 coupled to the support structure 620, the magnetic members 632 forming coil/magnet pairs with the magnetic members 630. The rigid member 602 may be substantially planar. At least one surface of each magnetic member 630 may be substantially co-planar with at least one surface of another magnetic member 630 of the plurality of magnetic members 630 and at least one surface of each magnetic member 632 may be substantially co-planar with at least one surface of another magnetic member 632.

Figure 7:
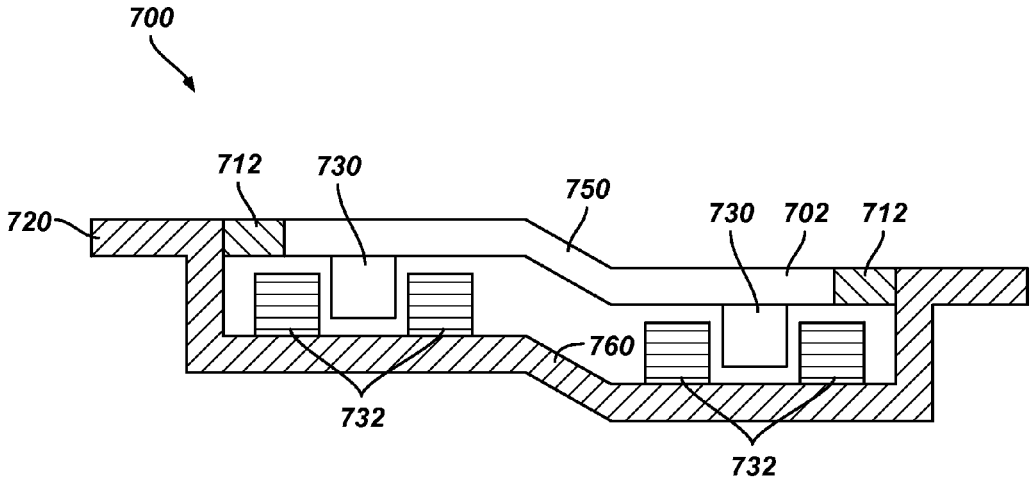
FIG. 7 is a simplified schematic illustrating a cross-sectional side view of a tactile vibration driver in accordance with an embodiment of the present disclosure.

FIG. 7 is a simplified schematic illustrating a cross-sectional side view of a tactile vibration driver 700 including a non-planar rigid member 702 according to other embodiments of the present disclosure. The rigid member 702 may be coupled to a support structure 720 via a suspension member 712. A plurality of magnetic members 730 may be coupled to the rigid member 702 and a plurality of magnetic members 732 may be coupled to the support structure 720. The rigid member 702, however, may include at least one surface that is located on a different plane than at least another surface of the rigid member 702. For example, the rigid member 702 may include one or more transition regions 750, wherein the rigid member 702 transitions from one planar surface to another planar surface. Thus, at least one magnetic member 730 of the plurality of magnetic members 730 may be coupled to the rigid member 702 at a different plane than at least another magnetic member 730 of the plurality of magnetic members 730. In some embodiments, the transition region 750 may include a curved surface rather than a planar surface. The support structure 720 may include one or more corresponding transition regions 760, wherein the support structure 720 transitions from one planar surface to another planar surface. At least one of the magnetic members 732 of the plurality of magnetic members 732 may be coupled to the support structure 720 at a different plane than at least another magnetic member 732 of the plurality of magnetic members 732. Accordingly, the tactile vibration driver 700 may be configured to conform to an outline of a user's body (e.g., an outline of the user's head, ear, etc.) or other point of contact with the user. The tactile vibration driver 700 may be configured to remain in contact with surfaces of a body of the user, even though the user's body may include surfaces that are non-planar (e.g., uneven).

Figure 8:
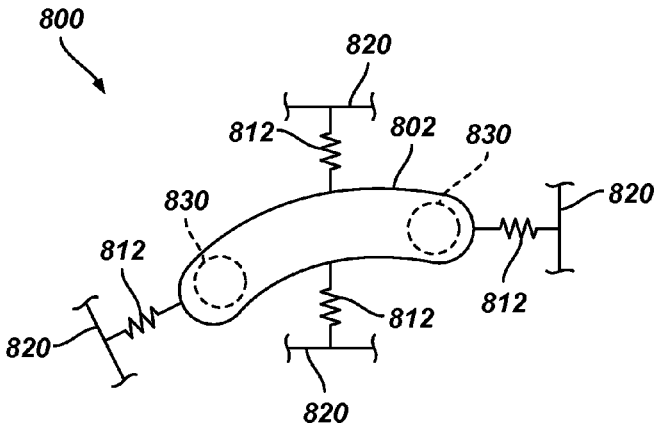
FIG. 8 through FIG. 11 are simplified schematic diagrams representing top views of tactile vibration drivers in accordance with embodiments of the present disclosure.

FIG. 8 is a simplified schematic diagram representing a top view of a tactile vibration driver 800 according to an embodiment of the present disclosure. The tactile vibration driver 800 may include a rigid member 802 coupled to a support structure 820 via a suspension member 812. The tactile vibration driver 800 may also include a plurality of magnetic members 830 associated with the rigid member 802. Any number of magnetic members 830 greater than one (e.g., 2, 3, 4, etc.) may be coupled to the rigid member 802.

The tactile vibration driver 800 may be semi-circular in shape and the rigid member 802 may exhibit a corresponding semi-circular shape. In some embodiments, the tactile vibration driver 800 may be sized and shaped to at least partially wrap around an ear of a user. As a result, the tactile vibration driver 800 may be configured to contact a user's head behind and/or above the user's ear.

Figure 9:
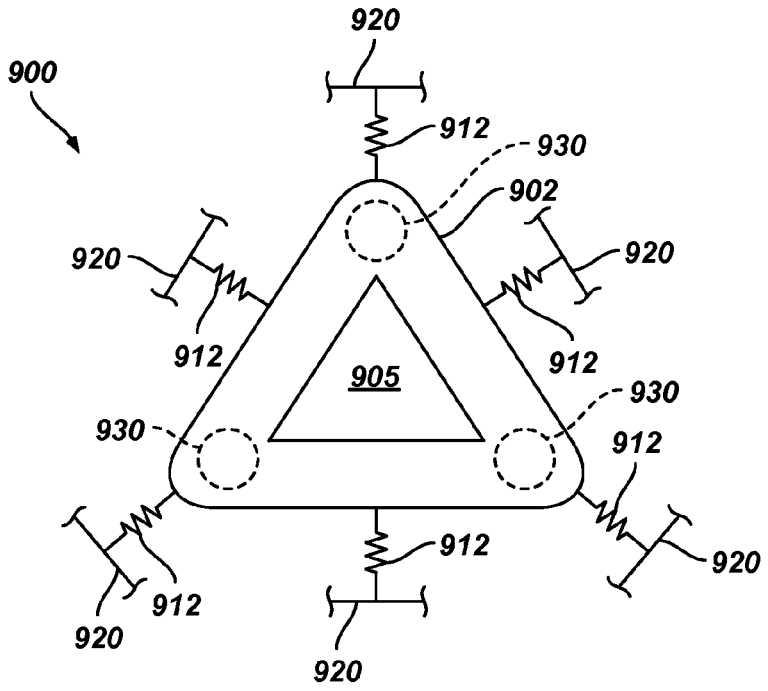

FIG. 9 is a simplified schematic diagram representing a top view of a tactile vibration driver 900 according to another embodiment of the present disclosure. The tactile vibration driver 900 may include a rigid member 902 coupled to a support structure 920 via a suspension member 912. The tactile vibration driver 900 may also include a plurality of magnetic members 930 associated with the rigid member 902.

The tactile vibration driver 900 may be triangular in shape and the rigid member 902 may have a corresponding triangular shape. In some embodiments, a magnetic member 930 may be located at each corner of the triangular shape of the rigid member 902, although the tactile vibration driver 900 may include any number of magnetic members 930. An opening 905 may be defined by inner surfaces of the rigid member 902. The opening 905 may be configured to receive an object or to allow an object to pass therethrough.

Figure 10:
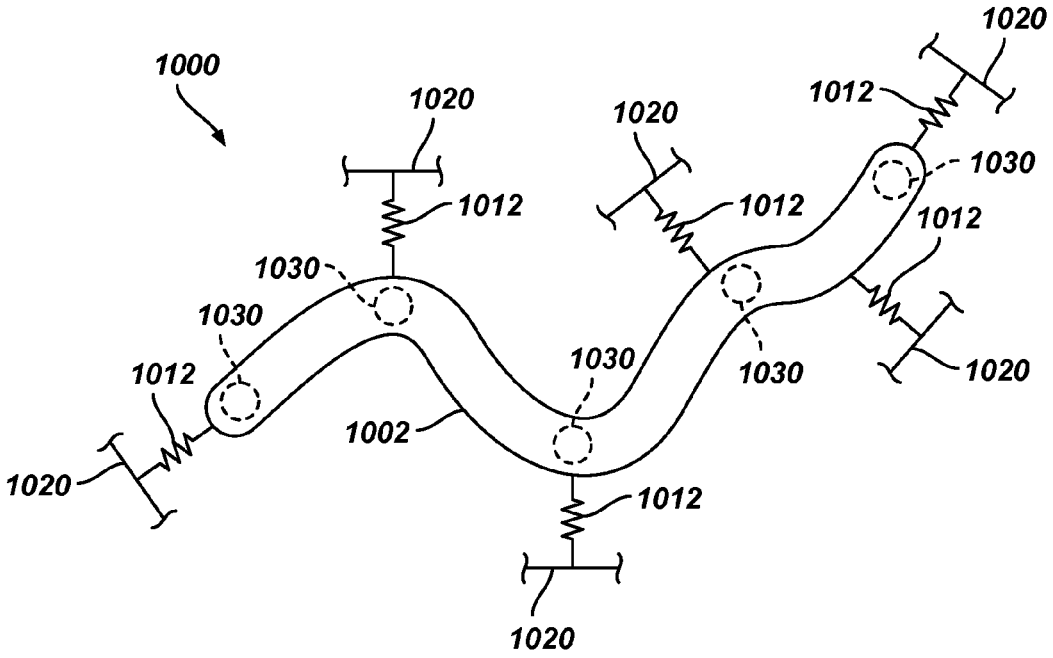

FIG. 10 is a simplified schematic diagram representing a top view of a tactile vibration driver 1000 according to yet another embodiment of the present disclosure. The tactile vibration 1000 may include a rigid member 1002 attached to a support structure 1020 via a suspension member 1012. The tactile vibration driver 1000 may also include a plurality of magnetic members 1030 attached to the rigid member 1002.

The tactile vibration driver 1000 and the rigid member 1002 may be serpentine-shaped and may include one or more semi-circular curves or portions. The magnetic members 1030 may be coupled to the rigid member 1002 at locations where a direction of an outer surface of the rigid member 1002 changes. The tactile vibration driver 1000 may be configured to at least partially conform to and contact a head of the user at a location outside the user's ear.

The tactile vibration drivers 600, 700, 800, 900, and 1000 of FIG. 6A through FIG. 10 may include a housing that is separate and distinct from a housing of an audio driver of an associated headphone. In some embodiments, a tactile vibration driver and the associated audio driver may be located within the same housing.

Figure 11:
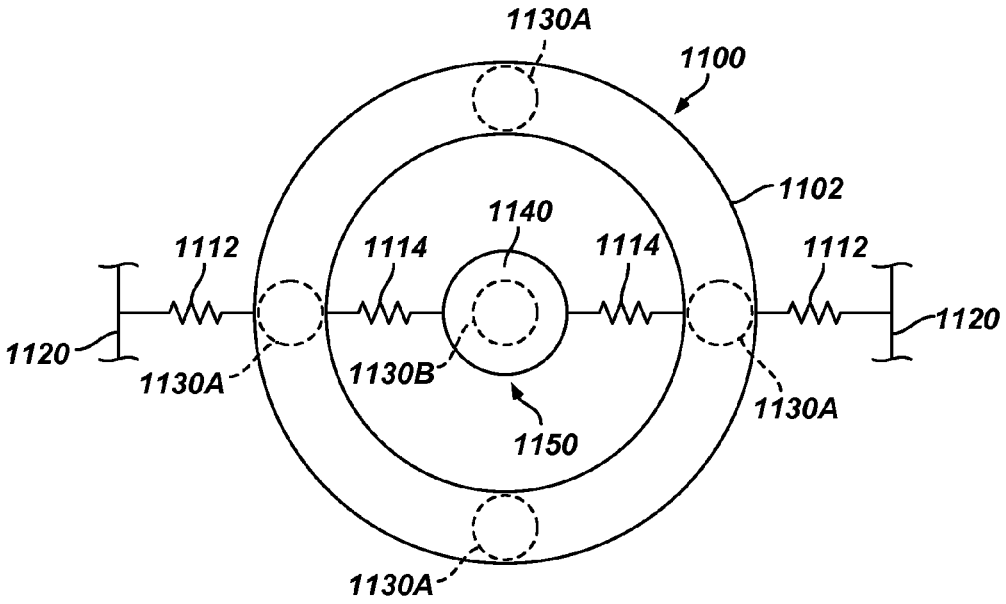

FIG. 11 is a simplified schematic diagram representing a top view of a tactile vibration driver 1100 according to yet another embodiment of the present disclosure. The tactile vibration driver 1000 may include an annular-shaped rigid member 1102 coupled to an annular-shaped support structure 1120 via a suspension member 1112. The annular-shaped rigid member 1102 may include a plurality of magnetic members 1130A attached thereto.

The annular-shaped rigid member 1102 may be coupled to a central audio driver 1150 via one or more suspension members 1114. The audio driver 1150 may be a conventional audio driver 1150 and may include a magnetic member 1130B coupled to an annular-shaped rigid member 1140 of the audio driver 1150. Accordingly, a multi-actuator tactile vibration driver 1100 may be concentric with, and substantially surround, the audio driver 1150.

Figure 12:
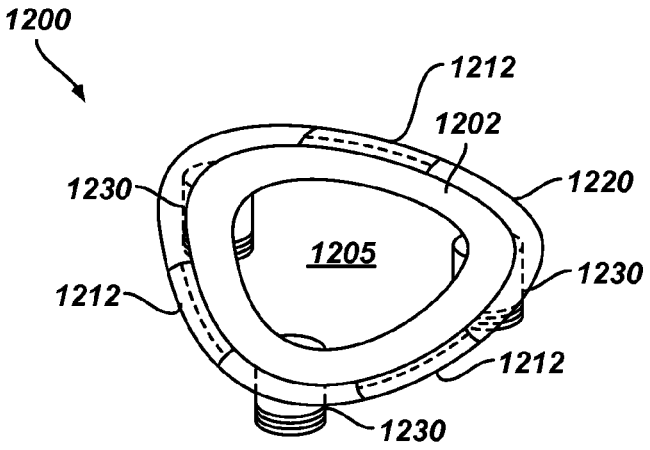
FIG. 12 is a simplified schematic illustrating a perspective view of a tactile vibration driver in accordance with an embodiment of the present disclosure.

FIG. 12 is a simplified view of an embodiment of a tactile vibration driver 1200 according to an embodiment of the present disclosure. The tactile vibration driver 1200 may include a rigid member 1202 attached to a suspension member 1212. Although the suspension member 1212 is shown as discontinuous around the rigid member 1202, the suspension member 1212 may be continuous around the entire periphery of the rigid member 1202 in other embodiments. The rigid member 1202 may be coupled to a support structure 1220 via the suspension member 1212. The tactile vibration driver 1200 may also include a plurality of magnetic members 1230 attached to the rigid member 1202.

The tactile vibration driver 1200 and the rigid member 1202 may be oval-shaped. An opening 1205 of the tactile vibration driver 1200 may be defined by inner surfaces of the rigid member 1202. The tactile vibration driver 1200 may be configured to contact a user's head outside the ear of the user to deliver tactile vibrations to the user while an audio driver of an associated headphone is placed in or over the ear of the user. Although the tactile vibration driver 1200 is illustrated as oval or triangular, the tactile vibration driver 1200 may be configured as other shapes, such as circular, rectangular, square, trapezoidal, etc.

Figure 13:
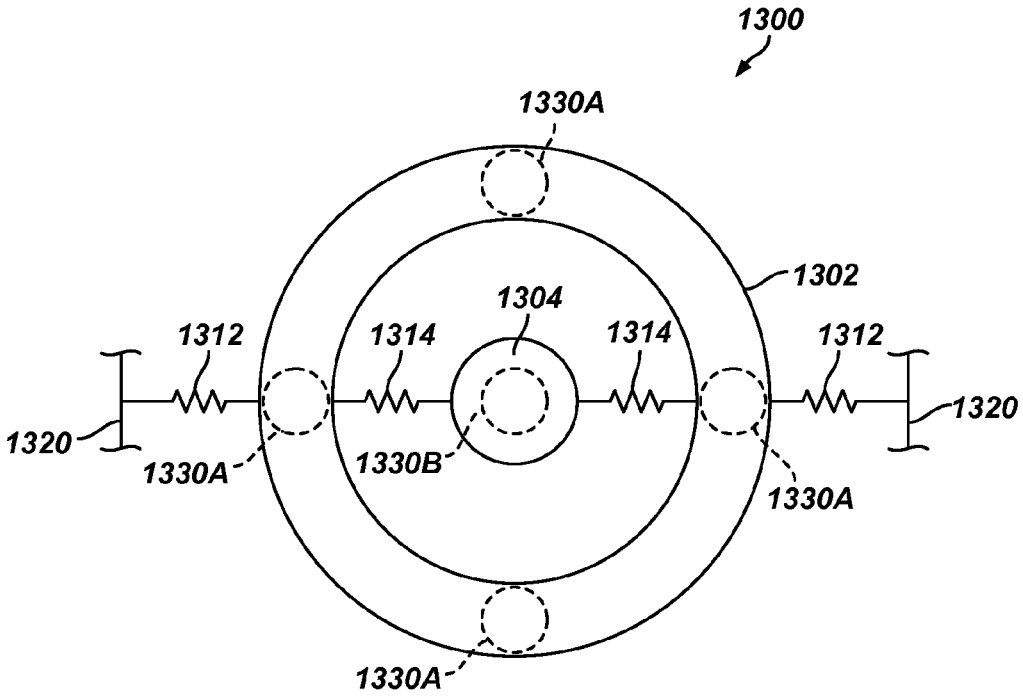
FIG. 13 is a simplified schematic diagram representing a top view of a tactile vibration driver in accordance with an embodiment of the present disclosure.

The tactile vibration drivers 600, 700, 800, 900, 1000, 1100, and 1200 of FIG. 6A through FIG. 12 illustrate tactile vibration drivers that include a single rigid member. In some embodiments, a tactile vibration driver may include more than one rigid member. FIG. 13 is a simplified schematic diagram representing a top view of a tactile vibration driver 1300 according to an embodiment of the present disclosure. The tactile vibration driver 1300 includes a first rigid member 1302 and a second rigid member 1304. The first rigid member 1302 may be coupled to a support structure 1320 via a first suspension member 1312. The first rigid member 1302 and the second rigid member 1304 may be coupled together via a second suspension member 1314.

The first rigid member 1302 may include a plurality of magnetic members 1330A coupled thereto. The first rigid member 1302 and the associated magnetic members 1330A may comprise a multi-actuator transducer. The second rigid member 1304 may include a single magnetic member 1330B coupled thereto and may comprise a transducer with a single actuator.

Although each of the rigid members 1302, 1304 may be driven by different magnetic members 1330A, 1330B, the rigid members 1302, 1304 may oscillate at substantially the same frequency or frequencies. However, in other embodiments, the first rigid member 1302 and the second rigid member 1304 may be independently driven by the controller 404 (FIG. 4) to produce different vibration responses for the tactile vibration driver 1300. Thus, the plurality of magnetic members 1330A may be driven at a different frequency than the magnetic member 1330B. By way of example, the controller 404 may output the second audio signal 405 (FIG. 4) as different channels of audio signals in order to control the vibration of the tactile vibration driver 1300. As a result, the first rigid member 1302 and the second rigid member 1304 may be independently controlled and driven by their respective associated channel in order to achieve different vibration responses.

In some embodiments, the rigid members 1302, 1304 may be generally circular and concentrically arranged with respect to each other. As a result, the first rigid member 1302 (e.g., the outer rigid member) may be configured as an annular disk that has a greater radius than the second rigid member 1304 (e.g., the center rigid member). In such a configuration, the suspension members 1312, 1314 may be attached to the edges of the respective rigid members 1302, 1304 to extend in a lateral, radial direction such that the suspension members 1312, 1314 oscillate by bending up and down (into and out of the plane of FIG. 13) to generate the vibrations.

The first suspension member 1312 and the second suspension member 1314 are each shown symbolically in FIG. 13 as a spring rather than as a physical representation. In some embodiments, one or more suspension members 1312, 1314 may be configured as a single structure (e.g., a diaphragm or a passive radiator) having an appropriate spring constant to couple the rigid members 1302, 1304 to each other, and to the support structure 1320. In some embodiments, a combination of different types of suspension members may be used. For example, the first suspension member 1312 may be configured as flexible beams while the second suspension member 1314 may be configured as a single, continuous diaphragm.

Figure 14:
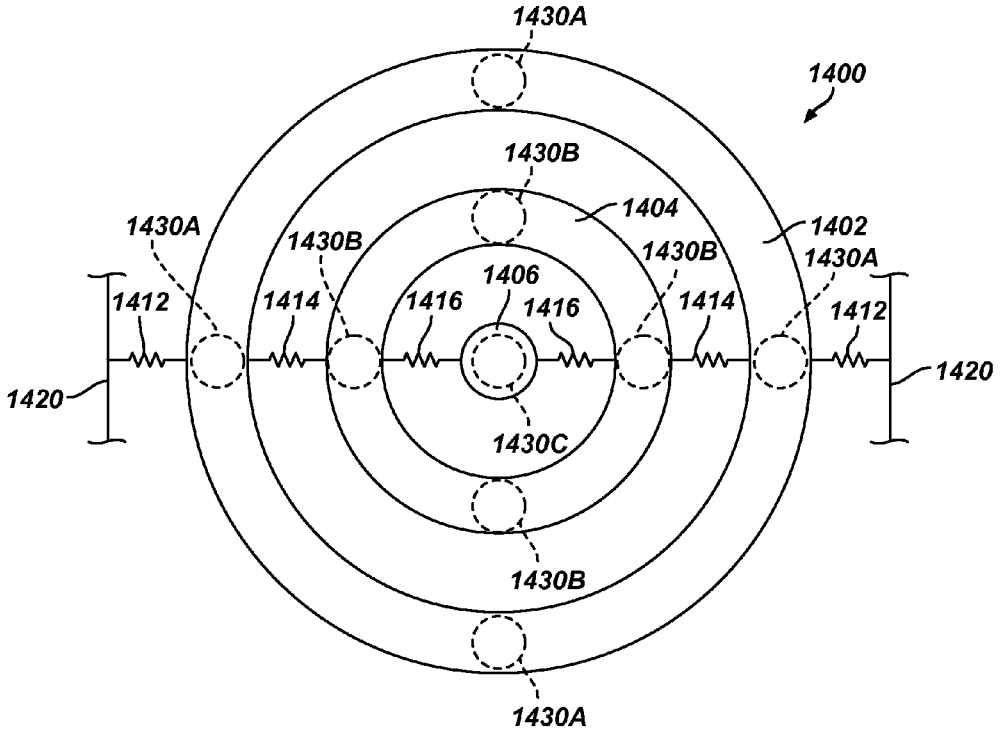
FIG. 14 is a simplified schematic diagram representing a top view of a tactile vibration driver in accordance with an embodiment of the present disclosure.

FIG. 14 is a simplified schematic diagram representing a top view of a tactile vibration driver 1400 according to another embodiment of the present disclosure. The tactile vibration driver 1400 includes a first rigid member 1402, a second rigid member 1404, and a third rigid member 1406. The first rigid member 1402 may be coupled to a support structure 1420 via a first suspension member 1412. The first rigid member 1402 and the second rigid member 1404 may be coupled together via a second suspension member 1414. The second rigid member 1404 and the third rigid member 1406 may be coupled together via a third suspension member 1416. The third rigid member 1406 may be the center of the tactile vibration driver 1400, and the second rigid member 1404 and the first rigid member 1402 may be annular disks of different diameters that are concentric with the third rigid member 1406.

The first rigid member 1402 may include a plurality of magnetic members 1430A. Each of the magnetic members 1430A of the first rigid member 1402 may be driven at the same frequency. The first rigid member 1402 and the associated magnetic members 1430A may comprise a multi-actuator transducer. The second rigid member 1404 may include a plurality of magnetic members 1430B and may comprise another multi-actuator transducer. Each of the magnetic members 1430B of the second rigid member 1404 may be driven at the same frequency. The third rigid member 1406 may include a single magnetic member 1430C and may comprise a transducer with a single actuator. Thus, the tactile vibration driver 1400 may include one or more multi-actuator transducers and may further include a single-actuator transducer. In some embodiments, each of the magnetic members 1430A, 1430B, 1430C may be driven at the same frequency. In other embodiments, the magnetic members 1430A, 1430B, 1430C may be independently driven by the controller 404 (FIG. 4) as discussed above with reference to FIG. 13.

Figure 15:
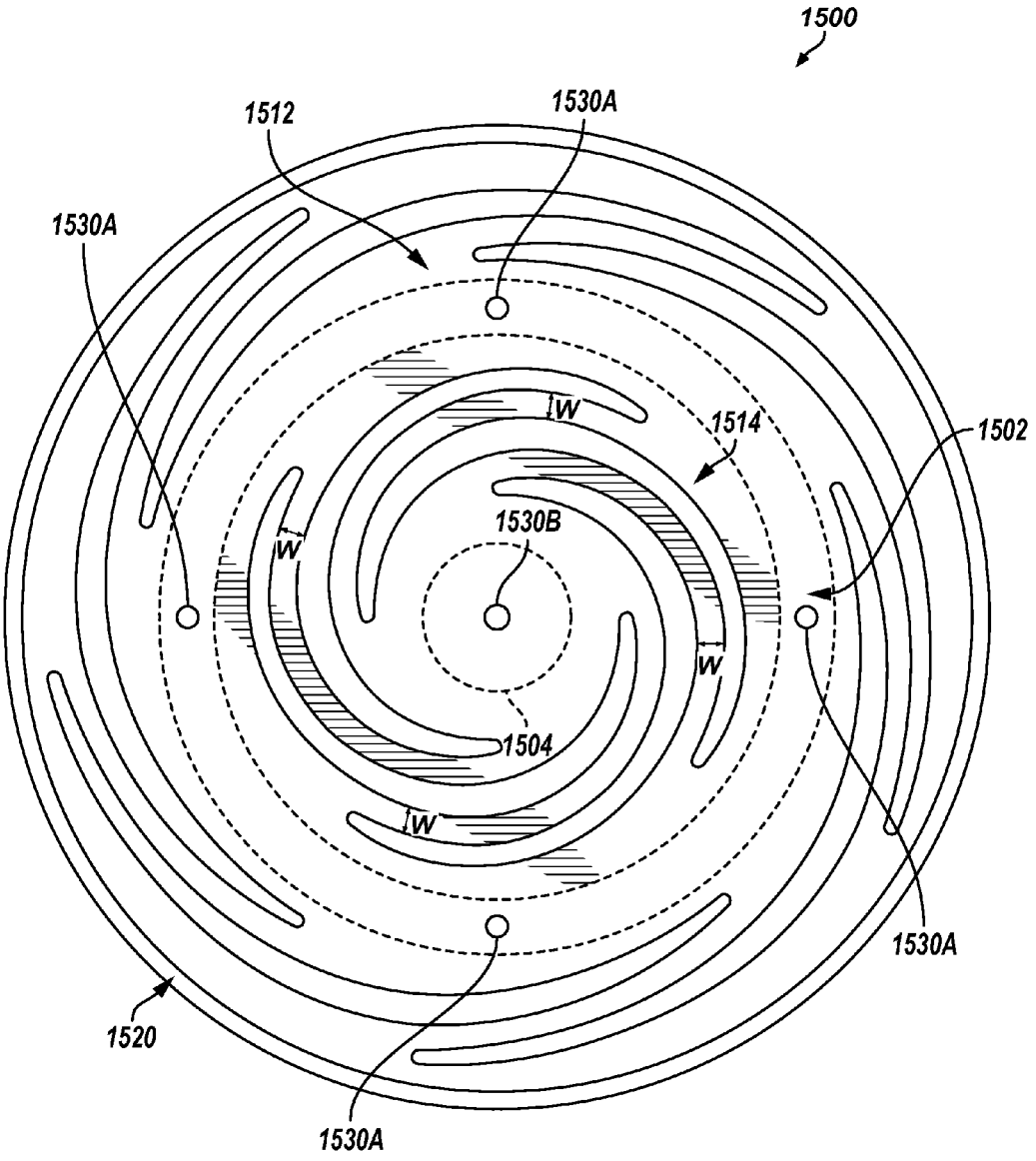
FIG. 15 is a top view of a portion of an embodiment of a tactile vibration driver in accordance with an embodiment of the present disclosure.

FIG. 15 is a top view of an embodiment of a tactile vibration driver 1500 according to another embodiment of the present disclosure. The tactile vibration driver 1500 may include a plurality of rigid members 1502, 1504 and a plurality of suspension members 1512, 1514. A first rigid member 1502 may be defined by an area between the outer two illustrated dashed circles. Magnetic members 1530A may be coupled to the first rigid member 1502. The second rigid member 1504 may be defined as the area within the middle dashed circle. Magnetic member 1530B may be coupled to the second rigid member 1504. The first rigid member 1502 may be coupled to a support structure 1520 via a first suspension member 1512. The first suspension member 1512 may extend from the first rigid member 1502 to the support structure 1520 and may be defined as an area between the first rigid member 1502 and the support structure 1520. The support structure 1520 may extend around a periphery of the first rigid member 1502. The first rigid member 1502 and the second rigid member 1504 may be coupled via a second suspension member 1514 that may be defined as the area between the first rigid member 1502 and the second rigid member 1504.

The suspension members 1512, 1514 and the rigid members 1502, 1504 may be integrally formed and may be configured as a single piece of material (e.g., stamped metal). The suspension members 1512, 1514 may be configured with flexible beams separated by apertures that enable the suspension members 1512, 1514 to be deformed and/or displaced relative to the resting plane during operation of the tactile vibration driver 1500. The rigid members 1502, 1504 may be solid regions that remain parallel to the resting plane while being displaced during operation of the tactile vibration driver 1500.

Figure 16:
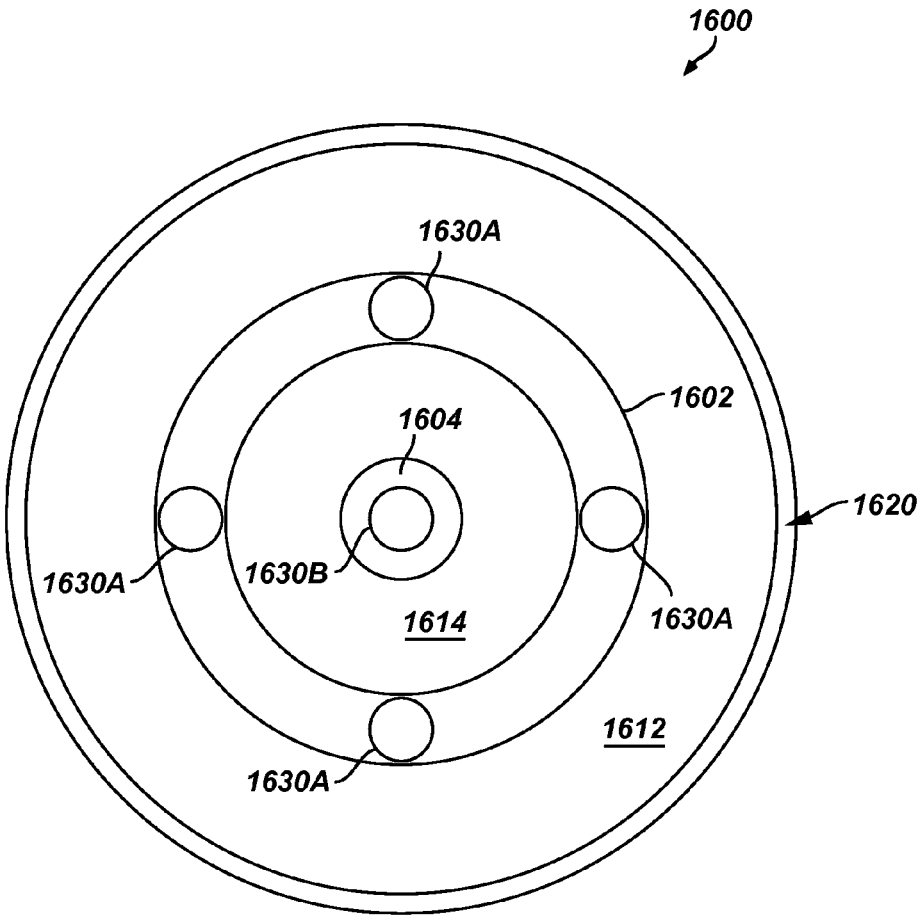
FIG. 16 is a top view of a portion of another embodiment of a tactile vibration driver in accordance with an embodiment of the present disclosure.

FIG. 16 is a top view of an embodiment of a tactile vibration driver 1600 according to another embodiment of the present disclosure. The tactile vibration driver 1600 includes a plurality of rigid members 1602, 1604 and a plurality of suspension members 1612, 1614. A first rigid member 1602 may be coupled to a support structure 1620 via a first suspension member 1612. The support structure 1620 may extend around a periphery of the first suspension member 1612. The first rigid member 1602 may be coupled to a second rigid member 1604 via a second suspension member 1614. The rigid members 1602, 1604 may include magnetic members 1630A, 1630B coupled thereto.

The suspension members 1612, 1614 may be formed from a flexible material (e.g., silicone speaker surround material) that enables the suspension members 1612, 1614 to be deformed and/or displaced relative to the resting plane during operation of the tactile vibration driver 1600. The rigid members 1602, 1604 may be formed from a more rigid material (e.g., a solid metal structure, a solid plastic structure, etc.) that remains parallel to the resting plane while being displaced during operation of the tactile vibration driver 1600.

In some embodiments, a tactile vibration driver may include a combination of suspension members that are formed with beams (e.g., FIG. 15) and a solid structure (e.g., FIG. 16). In other words, it is contemplated that a single tactile vibration driver may include at least one suspension member formed as flexible beams and at least one additional suspension member formed as a flexible material (e.g., silicone speaker surround material).

Figure 17:
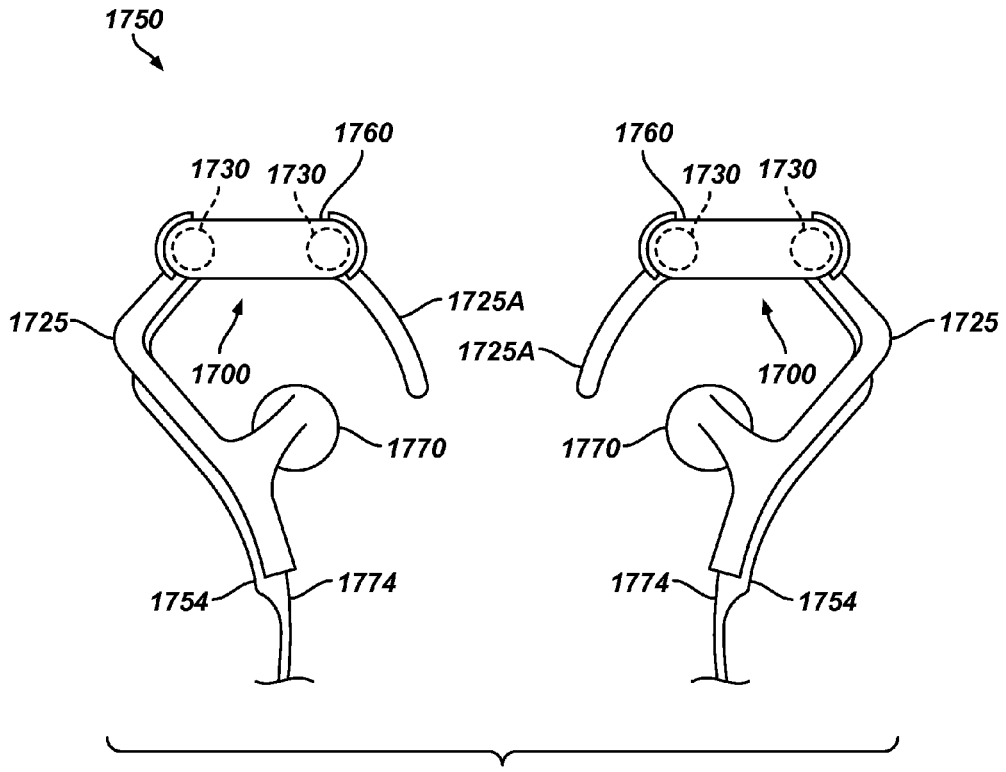
FIG. 17 is a simplified view of earbud assemblies of a headphone in accordance with an embodiment of the present disclosure.

FIG. 17 is a simplified view of a headphone 1750 including two earbud assemblies, each including tactile vibration drivers 1700 according to embodiments of the present disclosure. Each earbud assembly of the headphone 1750 may include earbuds 1770 configured to be placed within an ear of a user. A wiring system 1774 may be associated with the earbuds 1770 such that audio signals carried by the wiring system 1774 may be transmitted from a media player (e.g., media player 306 (FIG. 3)) to the earbuds 1770. Thus, an audio signal generated by the media player may be transmitted through the wiring system 1774 to the earbuds 1770 where the audio signal is converted to audible sound. In other embodiments, the audio signal generated by the media player may be transmitted wirelessly to the earbuds 1770.

The headphone 1750 may further include one or more tactile vibration drivers 1700. The tactile vibration driver 1700 may be similar to the tactile vibration drivers 600, 700, 800, 900, 1000, 1100, 1200, 1300, 1400, 1500, and 1600 described above with reference to FIG. 6A through FIG. 16. The tactile vibration driver 1700 may be substantially surrounded by (i.e., contained within) a housing 1760. A plurality of magnetic members 1730 may be attached to a rigid member within the housing 1760. Each of the magnetic members 1730 may be driven with the same electrical signal. For example, the magnetic members 1730 may be driven by the controller 404 (FIG. 4) as discussed above. The housing 1760 may be attached to a hangar 1725, 1725A. The hangar 1725 may position the tactile vibration driver 1700 in close proximity to a head of a user. In some embodiments, at least a portion of the hangar 1725 may be configured to extend around a backside of a user's ear and conform to the user's head behind the ear. The hangar 1725 may be secured to one of the earbuds 1770. The hangar 1725 also may be attached to the housing 1760 of the tactile vibration driver 1700.

A wiring system 1754 may be associated with the tactile vibration driver 1700. The wiring system 1754 may extend along the hangar 1725 and to the tactile vibration driver 1700. The wiring system 1754 may carry audio signals from a media player (e.g., media player 306 (FIG. 3)) to the tactile vibration driver 1700. Thus, an audio signal generated by the media player may be transmitted through the wiring system 1754 to the tactile vibration driver 1700 where the audio signal is converted to tactile vibrations. In other embodiments, the media player may wirelessly transmit the audio signal to the vibration driver 1700 using, for example, a BLUETOOTH® wireless connection, and the headphone 1750 may not include the wiring system 1754 or the wiring system 1774.

Thus, the headphone 1750 may include a tactile vibration driver 1700 in a housing separate from the earbuds 1770. Audible sound may be delivered to a user's ear via the earbuds 1770 and tactile vibrations may be delivered to a user via the tactile vibration driver 1700, which may be located in the housing 1760 remote from the earbuds 1770 and outside the ear. Accordingly, the earbud assemblies of the headphone 1750 may exhibit a relatively low profile since the audio driver and the tactile vibration driver 1700 are not stacked one over another within the same housing.

In some embodiments, one or more tactile vibration drivers may be coupled to a user-wearable accessory. Examples of user-wearable accessories may include helmets, hoods, a skull cap (sometimes referred to in the art as a tuque or a "beanie"), ski goggles, etc., as described in U.S. patent application Ser. No. 13/451,299, filed Apr. 19, 2012, published Jul. 11, 2013 as U.S. Patent Application Publication No. 2012/0177195, and titled "MODULAR AUDIO SYSTEMS AND RELATED ASSEMBLIES AND METHODS," the disclosure of which is hereby incorporated herein by this reference in its entirety. A plurality of tactile vibration drivers may be attached to the user-wearable accessories, which may be configured to support one or more tactile vibration drivers.

Figure 18:
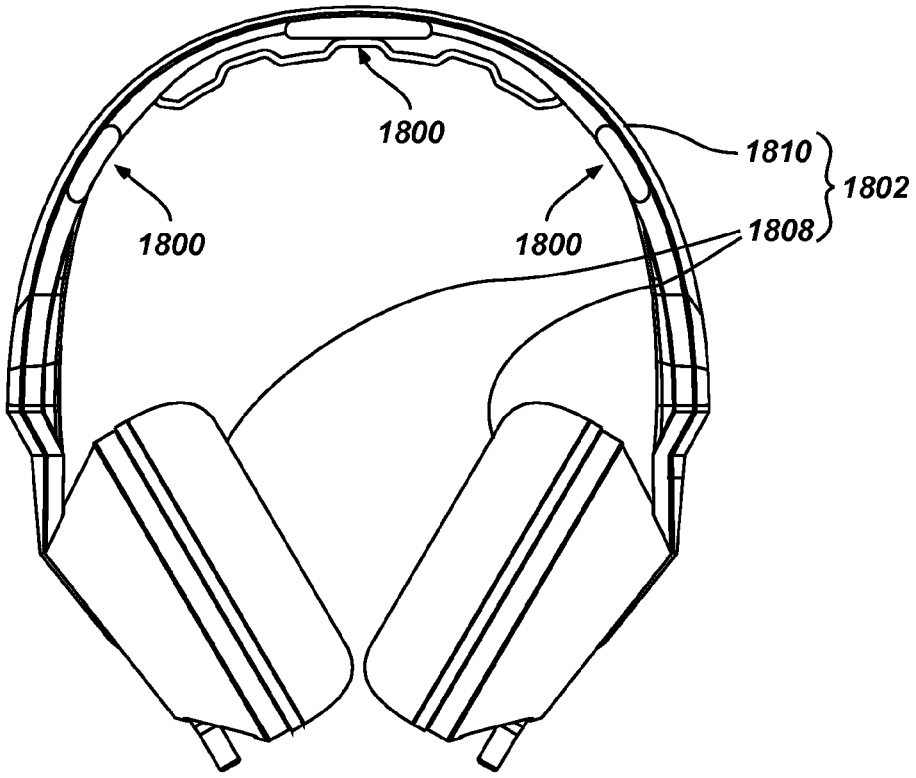
FIG. 18 is a simplified view of a headphone including a plurality of tactile vibration drivers mounted to a headband of a headphone in accordance with an embodiment of the present disclosure.

An exemplary user-wearable accessory may include a helmet. FIG. 18 is a simplified view of a headphone 1802 including a plurality of tactile vibration drivers 1800 mounted to a headband 1810 of the headphone 1802. The headphone 1802 may include ear cup assemblies 1808 that each may include an audio driver. The plurality of tactile vibration drivers 1810 may be attached to the headband 1810 at different locations along the headband 1810 to provide tactile vibrations to a head of a user. Although three tactile vibration drivers 1800 are illustrated in FIG. 18, any number of tactile vibration drivers 1800 (e.g., one, two, four, etc.) may be attached to the headband 1810.

Figure 19:
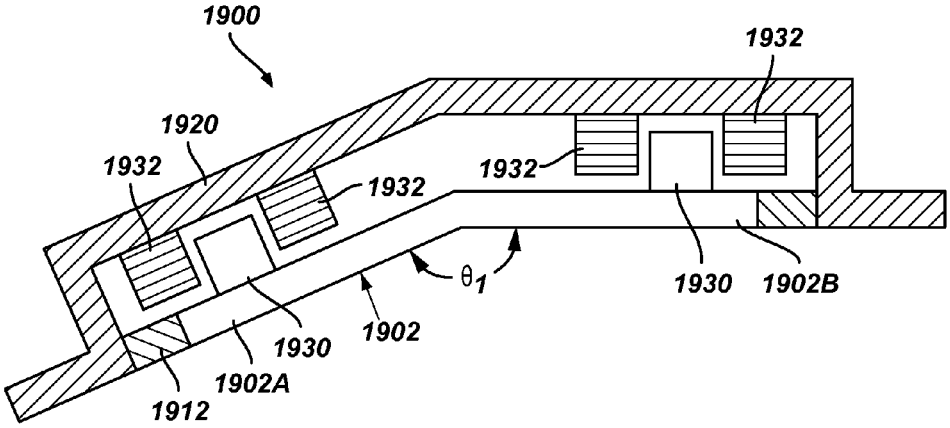
FIG. 19 is a simplified schematic illustrating a cross-sectional side view of a tactile vibration driver in accordance with an embodiment of the present disclosure.

FIG. 19 is a simplified cross-sectional side view of a tactile vibration driver 1900 configured to be coupled to the headband 1810 of FIG. 18. The tactile vibration driver 1900 may include a rigid member 1902 coupled to a support structure 1920 via a suspension member 1912. The rigid member 1902 may include a first portion 1902A and a second portion 1902B. The first portion 1902A may extend at an obtuse angle $\theta_1$ relative to the second portion 1902B. A plurality of magnetic members 1930 may be coupled to the rigid member 1902 and a plurality of magnetic members 1932 may be coupled to the support structure 1920. For example, at least one magnetic member 1930 may be coupled to each of the first portion 1902A and the second portion 1902B. The support structure 1920 may have a shape that corresponds to a shape of the rigid member 1902.

Figure 20:
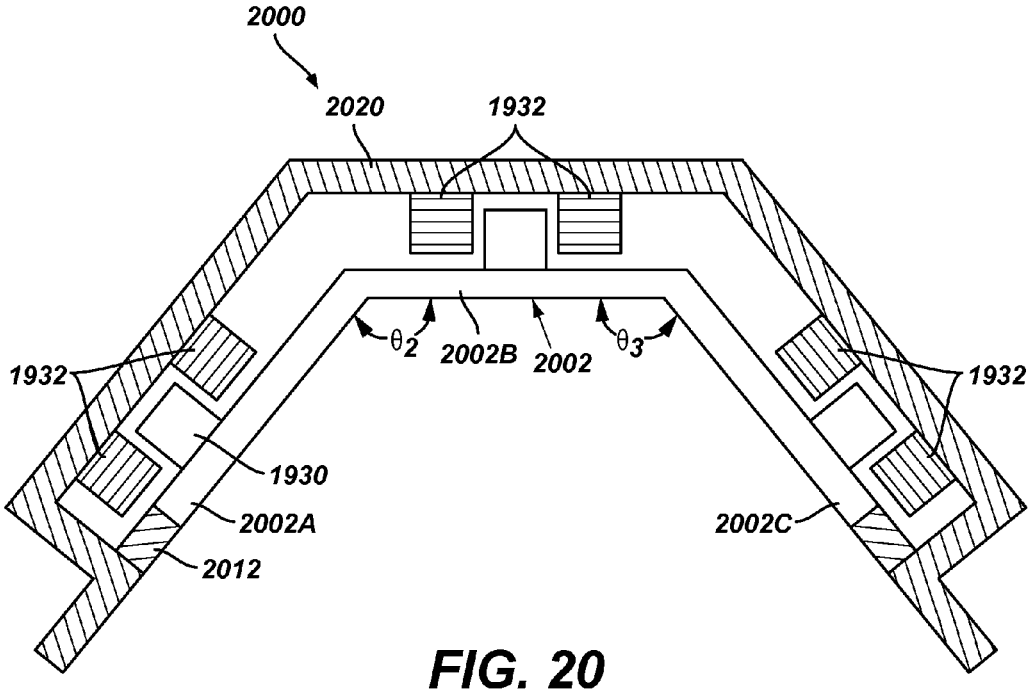
FIG. 20 is a simplified schematic illustrating a cross-sectional side view of a tactile vibration driver in accordance with an embodiment of the present disclosure.

FIG. 20 is a simplified cross-sectional side view of a tactile vibration driver 2000 configured to be coupled to the headband 1810 of FIG. 18. The tactile vibration driver 2000 may include a rigid member 2002 coupled to a support structure 2020 via a suspension member 2012. The tactile vibration driver 2000 be substantially similar to the tactile vibration driver 1900 of FIG. 19, except that the rigid member 2002 and the support structure 2020 may have a different shape than the rigid member 1902 and the support structure 1920 of FIG. 19. The rigid member 2002 may include a first portion 2002A, a second portion 2002B, and a third portion 2002C. The second portion 2002B may extend at an obtuse angle $\theta_2$ relative to the first portion 2002A, and the third portion 2002C may extend at an obtuse angle $\theta_3$ relative to the second portion 2002B. In some embodiments, the obtuse angle $\theta_2$ and the obtuse angle $\theta_3$ may be the same. One or more magnetic members 1930 may be coupled to each of the first portion 2002A, the second portion 2002B, and the third portion 2002C. The support structure 2020 may have a shape that corresponds to a shape of the rigid member 2002. Accordingly, the tactile vibration driver 2000 may be configured to be coupled to the headband 1810 and may be configured to contact a user at non-planar surfaces of the user's body (e.g., the user's head).

Figure 21:
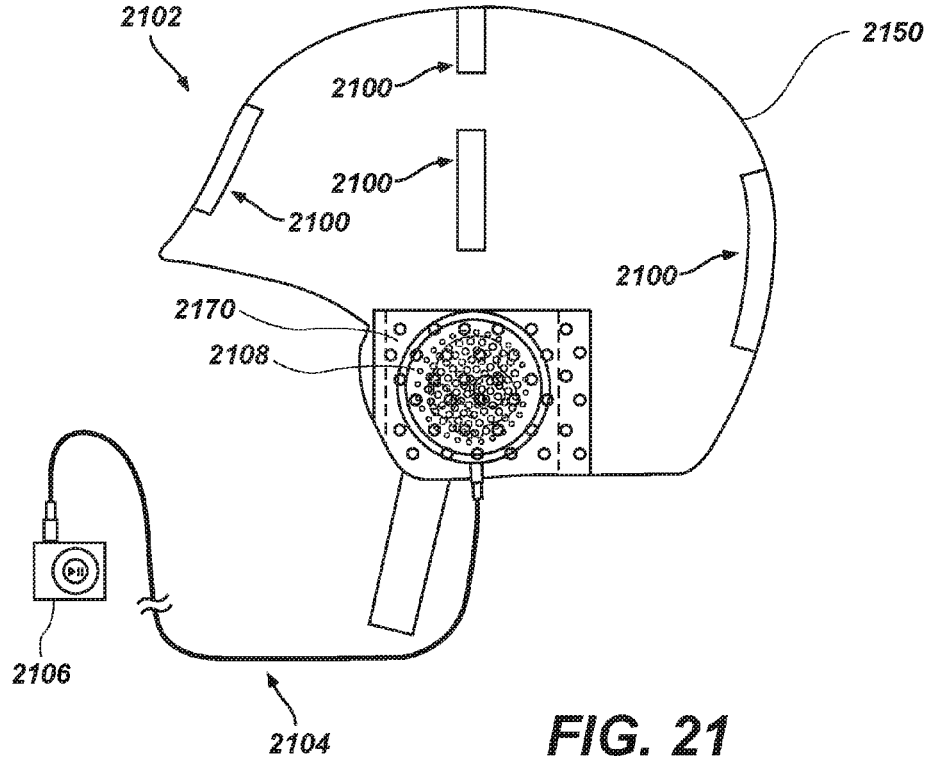
FIG. 21 is an interior simplified and schematically illustrated side view of a helmet including a headphone having one or more tactile vibration drivers in accordance with an embodiment of the present disclosure.

FIG. 21 is an interior simplified side view of an audio system 2102 including a helmet 2150 (e.g., a snowboard, ski, or skateboard helmet) having one of more tactile vibration drivers 2100. The helmet 2150 may be configured such that the one or more tactile vibration drivers 2100 may be secured within the helmet 2150 and configured to contact a user's head. The audio system 2102 may include a wiring system 2104 coupled to a headphone 2108 and a media player 2106. The headphone 2108 may be configured for placement in the helmet 2150. For example, a mesh liner 2170 may be attached to an inner portion of the helmet 2150 and configured to receive the headphone 2108.

One or more tactile vibration drivers 2100 may be secured to the helmet 2150 and configured to provide tactile vibrations to a user. The tactile vibration drivers 2100 may be secured to front surfaces, rear surfaces, side surfaces, and top surfaces of the interior of the helmet 2150. The tactile vibration drivers 2100 may receive an audio signal from the wiring system 2104 or may receive the audio signals wirelessly, such as via a Bluetooth® wireless connection.

Figure 22:
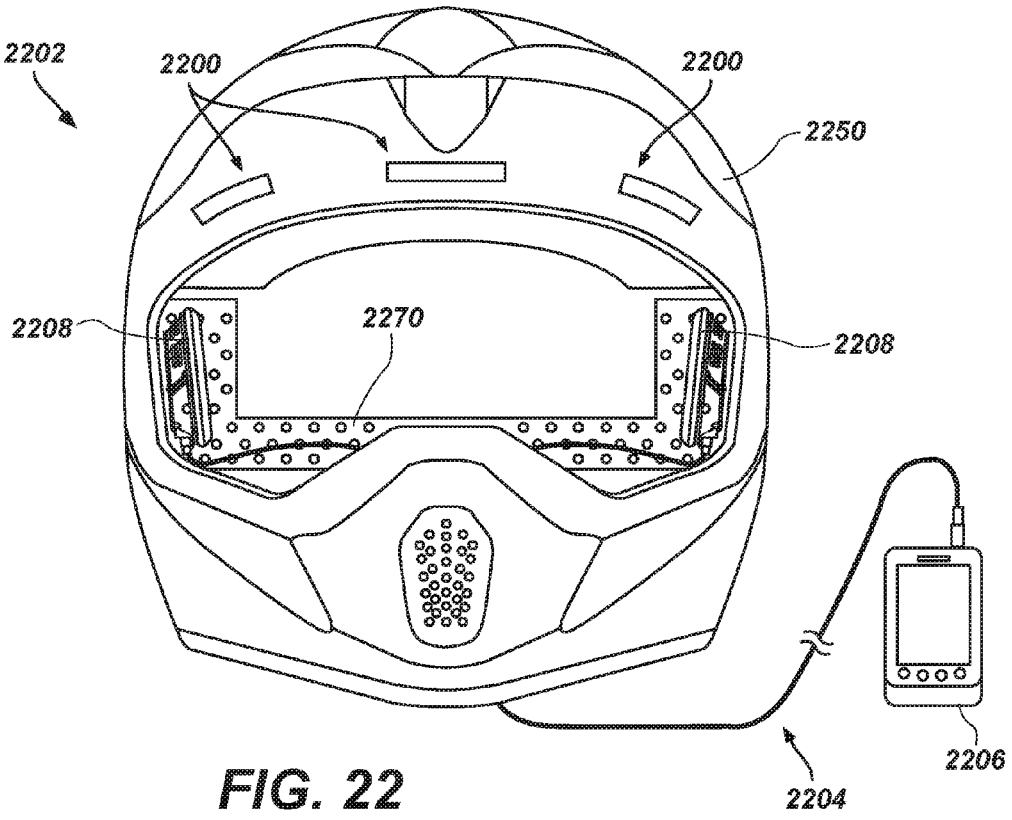
FIG. 22 is a front view of a full-face helmet including a headphone having one or more tactile vibration drivers in accordance with an embodiment of the present disclosure.

FIG. 22 is a front view of a full-face helmet 2250 of an audio system 2202 including a headphone 2208 having one or more tactile vibration drivers 2200. The tactile vibration drivers 2200 may be secured to an inner portion of the full-face helmet 2250. The audio system 2202 may include a wiring system 2204, and a media player 2206. The headphone 2208 may be configured for placement in the helmet 2250. For example, a mesh liner 2270 may be attached to an inner portion of the helmet 2250 and configured to receive the headphone 2208.

The helmet 2250 may include one or more tactile vibration drivers 2200 configured to provide tactile vibrations to a user. The tactile vibration drivers 2200 may be secured to front surfaces, top surfaces, back surfaces, and side surfaces along the interior of the helmet 2250. The tactile vibration drivers 2200 may receive an audio signal from the wiring system 2204 or may receive the audio signals wirelessly, such as via a BLUETOOTH® wireless connection.

Additional non-limiting embodiments are described below.

Embodiment 1

A tactile vibration driver for use in a headphone, comprising: a support structure; at least one suspension member suspending at least one rigid member relative to the support structure; and a plurality of magnetic members attached to the at least one rigid member and configured to drive oscillating movement of the at least one rigid member and the at least one suspension member so as to produce tactile vibrations during operation of the tactile vibration driver.

Embodiment 2

The tactile vibration driver of Embodiment 1, wherein each of the plurality of magnetic members is configured to be driven at the same frequency during operation of the tactile vibration driver.

Embodiment 3

The tactile vibration driver of Embodiment 1 or Embodiment 2, wherein at least one magnetic member of the plurality of magnetic members is attached to the at least one rigid member at a different plane than another magnetic member of the plurality of magnetic members.

Embodiment 4

The tactile vibration driver of any one of Embodiments 1 through 3, further comprising a housing for the tactile vibration driver that is separate and distinct from a housing of an audio driver of the headphone.

Embodiment 5

The tactile vibration driver of any one of Embodiments 1 through 4, further comprising a hangar attached to the tactile vibration driver, wherein the hangar is configured to position the tactile vibration driver proximate a head of a user.

Embodiment 6

The tactile vibration driver of Embodiment 5, further comprising an earbud coupled to the hangar.

Embodiment 7

The tactile vibration driver of any one of Embodiments 1 through 3, wherein the tactile vibration driver substantially surrounds an audio driver of the headphone.

Embodiment 8

The tactile vibration driver of any one of Embodiments 1 through 7, further comprising an opening defined by inner surfaces of the at least one rigid member.

Embodiment 9

The tactile vibration driver of any one of Embodiments 1 through 8, wherein the at least one rigid member is oval-shaped, circular-shaped, semicircular-shaped, triangular-shaped, serpentine-shaped, square-shaped, rectangular-shaped, or trapezoidal-shaped.

Embodiment 10

The tactile vibration driver of any one of Embodiments 1 through 8, further comprising at least another rigid member, at least another magnetic member attached to the at least another rigid member and configured to drive oscillating movement of the at least another rigid member.

Embodiment 11

The tactile vibration driver of Embodiment 10, wherein the at least one rigid member and the at least another rigid member are concentric with each other.

Embodiment 12

An audio system including a media player configured to send an electrical audio signal to at least one tactile vibration driver of the audio system, the at least one tactile vibration driver comprising: at least one rigid member; at least one suspension member coupled to the at least one rigid member and a support structure; and a plurality of magnetic members attached to the at least one rigid member, wherein each magnetic member of the plurality of magnetic members is configured to oscillate relative to the support structure and generate tactile vibrations responsive to receipt of the electrical audio signal.

Embodiment 13

The audio system of Embodiment 12, wherein the at least one tactile vibration driver is configured to contact a surface of a head of a user.

Embodiment 14

The audio system of Embodiment 12 or Embodiment 13, further comprising an earbud configured to fit within an ear of the user.

Embodiment 15

The audio system of Embodiment 12 or Embodiment 13, wherein the at least one tactile vibration driver is secured to a headband of a headphone.

Embodiment 16

The audio system of Embodiment 12 or Embodiment 13, wherein the at least one tactile vibration driver is disposed within an ear cup of a headphone.

Embodiment 17

The audio system of Embodiment 12 or Embodiment 13, further comprising a headphone including a headband, a plurality of tactile vibration drivers secured to the headband.

Embodiment 18

The audio system of any one of Embodiments 12 through 14, wherein the at least one tactile vibration driver is secured to a helmet.

Embodiment 19

The audio system of Embodiment 12 or Embodiment 13, wherein the tactile vibration driver is coupled to one of a hood, a skullcap, or ski goggles.

Embodiment 20

The audio system of any one of Embodiment 12 or Embodiment 13, further comprising an audio driver, the at least one tactile vibration driver substantially surrounding and concentric with the audio driver.

Embodiment 21

A method of operating a tactile vibration driver, the method comprising: driving a plurality of magnetic members attached to a rigid member of the tactile vibration driver to cause oscillations of the plurality of magnetic members and the rigid member relative to a suspension member and producing tactile vibrations responsive to receipt of an electrical signal.

Embodiment 22

The method of Embodiment 21, wherein driving a plurality of magnetic members comprises driving the plurality of magnetic members at a bass frequency.

Embodiment 23

The method of Embodiment 21 or Embodiment 22, further comprising attaching at least one magnetic member of the plurality of magnetic members on a different plane than another magnetic member of the plurality of magnetic members and driving each of the plurality of magnetic members at the same frequency.

Embodiment 24

The method of any one of Embodiments 21 through 23, further comprising disposing the tactile vibration driver in a housing separate and distinct from a housing of an audio driver associated with the tactile vibration driver.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one embodiment may be combined with features of another embodiment while still being encompassed within the scope of embodiments of the invention as contemplated by the inventors.

What is claimed is:

1. A tactile vibration driver for use in a headphone, comprising:
- a support structure;
- at least one suspension member;
- at least one rigid member; and
- a plurality of magnetic members, the plurality of magnetic members comprising:
  - a first pair of magnetic members located in a first location on the at least one rigid member and in a first location on the at least one suspension member; and
  - a second pair of magnetic members located in a second location on the at least one rigid member and in a second location on the at least one suspension member;
- wherein the at least one suspension member suspends the at least one rigid member relative to the support structure; and
- wherein the plurality of magnetic members is attached to the at least one rigid member and configured to drive oscillating movement of the at least one rigid member and the at least one suspension member so as to produce tactile vibrations during operation of the tactile vibration driver.

2. The tactile vibration driver of claim 1, wherein each of the plurality of magnetic members is configured to be driven at an operating frequency during operation of the tactile vibration driver.

3. The tactile vibration driver of claim 1, wherein at least one magnetic member of the plurality of magnetic members is attached to the at least one rigid member at a different plane than another magnetic member of the plurality of magnetic members.

4. The tactile vibration driver of claim 1, further comprising a housing for the tactile vibration driver that is separate and distinct from a housing of an audio driver of the headphone.

5. The tactile vibration driver of claim 1, wherein the tactile vibration driver substantially surrounds an audio driver of the headphone.

6. The tactile vibration driver of claim 1, further comprising an opening defined by inner surfaces of the at least one rigid member.

7. The tactile vibration driver of claim 1, wherein the at least one rigid member is oval-shaped, circular-shaped, semicircular-shaped, triangular-shaped, serpentine-shaped, square-shaped, rectangular-shaped, or trapezoidal-shaped.

8. An audio system including a media player configured to send an electrical audio signal to at least one tactile vibration driver of the audio system, the at least one tactile vibration driver comprising:
- a support structure;
- at least one suspension member;
- at least one rigid member; and
- a plurality of magnetic members, the plurality of magnetic members comprising:
  - a first pair of magnetic members located in a first location on the at least one rigid member and in a second location on the at least one suspension member; and
  - a second pair of magnetic members located in a second location on the at least one rigid member and in a second location on the at least one suspension member;
- wherein the at least one suspension member is coupled to the at least one rigid member and the support structure; and
- wherein the plurality of magnetic members is attached to the at least one rigid member and each magnetic member of the plurality of magnetic members is configured to oscillate relative to the support structure and generate tactile vibrations responsive to receipt of the electrical audio signal.

9. The audio system of claim 8, wherein the at least one tactile vibration driver is configured to contact a surface of a head of a user.

10. The audio system of claim 8, wherein the at least one tactile vibration driver is secured to a headband of a headphone.

11. The audio system of claim 8, wherein the at least one tactile vibration driver is disposed within an ear cup of a headphone.

12. The audio system of claim 8, further comprising a headphone including a headband, a plurality of tactile vibration drivers secured to the headband.

* * * * *